United States Patent [19]

Gladden

[11] 4,453,365

[45] Jun. 12, 1984

[54] EDGE TRIM STRUCTURE FOR ACCESS FLOOR PANEL

[75] Inventor: Robert S. Gladden, Severna Park, Md.

[73] Assignee: Tate Architectural Products, Inc., Jessup, Md.

[21] Appl. No.: 335,529

[22] Filed: Dec. 29, 1981

[51] Int. Cl.[3] ..... E04C 2/38; E04F 19/02

[52] U.S. Cl. ..... 52/716; 52/821

[58] Field of Search ..... 52/716, 288, 263, 821, 52/211, 785

[56] References Cited

U.S. PATENT DOCUMENTS

| | | | |
|---|---|---|---|
| 72,634 | 12/1867 | Heywood | 52/821 X |
| 1,851,055 | 3/1932 | O'Connor et al. . | |
| 2,925,631 | 2/1960 | Larson et al. . | |
| 2,956,652 | 10/1960 | Liskey, Jr. . | |
| 3,065,506 | 11/1962 | Tremer . | |
| 3,067,843 | 12/1962 | Rushtoh et al. . | |
| 3,150,748 | 9/1964 | Liskey, Jr. . | |
| 3,157,254 | 11/1964 | Spiselman et al. . | |
| 3,180,460 | 4/1965 | Liskey, Jr. . | |
| 3,318,057 | 5/1967 | Norsworthy . | |
| 3,548,559 | 12/1970 | Levine . | |
| 3,728,833 | 4/1973 | Grossman . | |
| 3,841,682 | 10/1974 | Church et al. | 52/716 X |
| 3,869,106 | 3/1975 | Gregov | 52/716 X |
| 4,035,967 | 7/1977 | Harvey . | |
| 4,074,488 | 2/1978 | Ray . | |
| 4,085,557 | 4/1978 | Tharp . | |
| 4,142,341 | 3/1979 | Mott . | |
| 4,229,919 | 10/1980 | Hughes . | |
| 4,279,109 | 7/1981 | Madl, Jr. . | |
| 4,295,319 | 10/1981 | Griffin . | |
| 4,364,591 | 12/1982 | Bien | 52/716 |

*Primary Examiner*—J. Karl Bell

*Attorney, Agent, or Firm*—Oblon, Fisher, Spivak, McClelland & Maier

[57] ABSTRACT

An edge trim structure for an access floor panel which includes at least a first and second separate edge trim member wherein each of the first and second separate edge trim members includes a first and second edge trim leg member and at least one continuous, one-piece edge trim corner member interconnecting the first and second edge trim leg member of each edge trim member. A mechanism for attaching each of the edge trim members to the panel is utilized which may include an adhesive member and/or at least one securing member integrally projecting from each of the edge trim members and operably engaging the panel.

14 Claims, 4 Drawing Figures

EDGE TRIM STRUCTURE FOR ACCESS FLOOR PANEL

BACKGROUND OF THE INVENTION

1. Field of the Invention

The present invention is directed to an edge trim structure for an access floor panel.

2. Description of the Prior Art

The development and proliferation of large scale electronic computer systems has necessitated the development of special flooring, known as "access flooring", upon which the computer system components can be supported and beneath which the interconnecting cables and other mechanical and electrical services can be distributed horizontally. An access floor system comprises a series of square modular floor panels which form the deck and which are supported on adjustable pedestals. Each access floor panel is a complete, finished entity unto itself, having all of the characteristics of the total system, including interchangeability, load bearing capability, ready removability, the ability to be penetrated for passing through of services, and a module of the floor covering selected for the computer room.

In view of the fact that some of the floor coverings normally used in computer rooms are brittle, such as high pressure laminate and certain other floor tile materials, and require some protection at their edges to prevent chipping when the panels are taken into and out of the floor system, each access floor panel is fitted with a "edge trim" such as that shown in U.S. Pat. No. 3,548,559 which show the use of separate edge trim only along the sides thereof. This edge trim surrounds the floor covering, is flush with the top of same, and the edge trim must be capable of withstanding rough handling and traffic wear without breaking or becoming dislodged from the panel. Further, since the panel surface must be electrically non-conductive and be electrically isolated from the panel structure the edge trim material must be a non-metal, not an integral part of the metal panel structure. These considerations place a premium on the integrity of the trim itself and its method of attachment to the panel periphery.

Current art has attempted to satisfy these requirements using straight lengths of plastic extrusions intended to "grip" the panel edge flanges or which is fitted into a groove and subsequently "captured" by permanent deformation of the groove. These methods of affixing edge trim to access floor panels are not permanent in the case of the former and do not allow replacement of broken trim in the latter instance. Also current art provides that joints between edge trim extrusions occur at the panel corners where the pieces are simply mitered or butted. Due to manufacturing tolerances, such joints are often open or misaligned resulting in poor finished appearance. More important, since the corners of access floor panels are most vulnerable to mishandling damage and since butted or mitered trim is not physically jointed together such as is the case in U.S. Pat. No. 3,548,559, mishandling or even normal rough use frequently causes the edge trim to become displaced at the corners, resulting in lost or broken trim and a very unsightly, if not unsafe, finished floor surface.

SUMMARY OF THE INVENTION

The primary objective of this invention is to produce an edge trim for access floor panels meeting the needs set forth hereinabove while eliminating the shortcomings of current art.

A secondary objective of this invention is to produce an edge trim which, if it should become dislodged, can be readily replaced.

A tertiary objective of this invention is to produce an edge trim which, with its method of attachment, can control the overall panel size to tolerances more precisely than current art.

In accordance with the present invention an edge trim structure is provided for an access floor panel which includes at least a first and second separate edge trim member each of which includes a first and second edge trim leg member and at least one continuous, one-piece edge trim corner member interconnecting each first and second edge trim leg member of each of the first and second separate edge trim members.

A mechanism for attaching the edge trim structure to the panel is also utilized which may constitute an adhesive member, a securing member integrally projecting from each of the separate edge trim members and operably engaging the panel or a combination of same. At least one securing member may constitute a rivet extending from the corner member and/or at least one rivet extending from each of the first and second leg members of each of the separate first and second edge trim members.

To meet the objects set forth, a new type of edge trim is provided, incorporating a continuous corner and locating the joints between edge trim sections at the center of each side of the panel which itself is made of, for example, steel, a place far less vulnerable to in service damage. Four identical angle shaped pieces of trim surround and enclose the floor covering in a preferred embodiment and the finished appearance of all corners is consistent and uniform throughout the floor system.

This edge trim is affixed to the steel panel by means of an adhesive bond matrix along the peripheral portion thereof. For additional strength, the option of an integral rivet at the continous corner of the edge trim may be used. Four corner holes are punched at the corners of the steel panel, allowing for positive positioning of the edge trim and a mechanical fixing of the continuous corner. The rivet passes down through the punched hole in the panel and is headed in the manufacturing operation to mechnically capture the trim in place by a headed portion. Since the steel panel has not been deformed to capture the trim edge, should severe abuse make it necessary to replace the trim, it can be readily done with no special tools.

For maximum mechanical attachment, a series of holes is punched in the perimeter flange of the steel panel, and a series of integral rivets as part of the edge trim structure as used to mechanically attach the edge trim to the steel panel in addition to the adhesive bond. This method of assembly makes it possible to locate the position of the trim most accurately, independent of other manufacturing tolerances. Since the edge trim determines the overall panel size, this critical dimension is more tightly controlled. This series of integral rivets are headed in production in the same manner as the single corner rivet is headed. Similarly, should severe abuse make it necessary to replace the trim, it can be done without special tools. The edge trim may be constructed of plastic, vinyl or similar material.

BRIEF DESCRIPTION OF THE DRAWINGS

Various objects, features and attendant advantages of the present invention will be more fully appreciated as the same becomes better understood from the following detailed description when considered in connection with the accompanying drawings in which like reference characters designate like or corresponding parts throughout the several views and wherein.

DETAILED DESCRIPTION OF THE PREFERRED EMBODIMENT

To provide an understanding of certain terms used in the specification and claims of this application, the following definitions are set forth:

1. EDGE TRIM STRUCTURE—The peripheral structure of an access floor panel which surrounds the floor tile to protect the tile from chipping, and to function as a sizing mechanism for the overall panel completing the panel assembly esthetically and functionally and capable of withstanding rough-handling and traffic wear without breaking or becoming dislodged from the panel.

2. INTEGRAL RIVETS—Projections included as part of the edge trim structure, used to mechnically fix the edge trim structure to the panel at the corner of the edge trim or along the sides of the edge trim.

3. ELECTRICALLY ISOLATE—Prevent electrical contact between a steel panel surface and the work surface of the finished access floor system.

4. CONTINUOUS CORNER—Design of the corner section of the edge trim structure so that the edge trim is continuous around a corner of a predetermined angle, with consistent material width and thickness around the corner to form a finished corner for the access floor panel wherein the length of the legs of the angle defined are substantially greater than the width of the edge trim structure.

5. HEADED—The manufacturing process of altering the configuration of the projection, from a straight projection to a formed head, similar to cold head riveting in steel fabrication. Heading can be performed by various mechanical methods, including heat setting, ultrasonic vibration, or spin setting.

Figure 1:
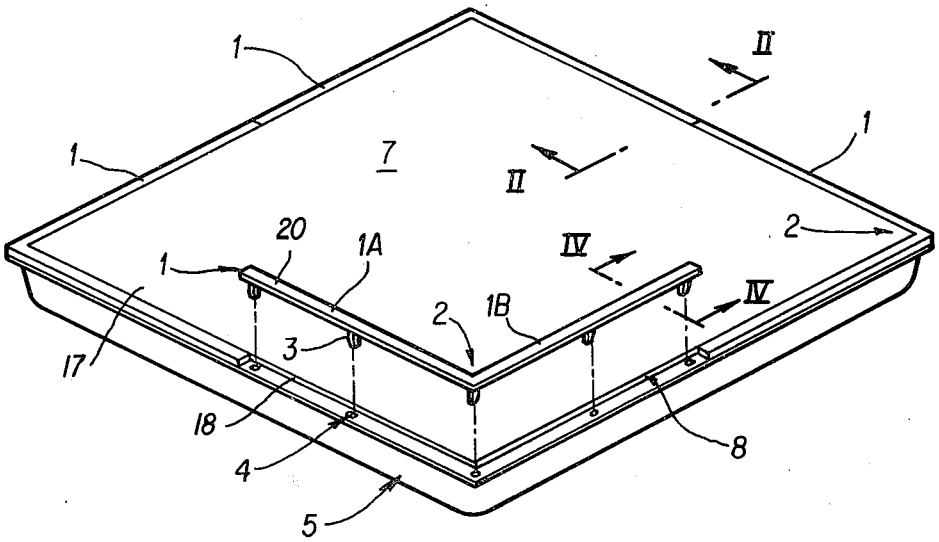
FIG. 1 is an isometric view of an access floor panel assembly which includes a floor panel and four pairs of edge trim supports in accordance with the present invention.
Figure 2:
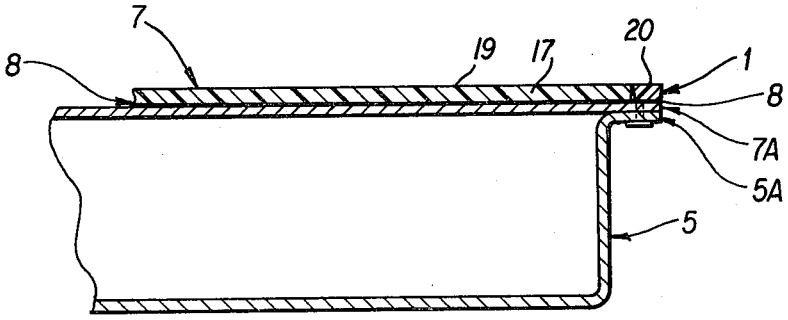
FIG. 2 is a partial cross-sectional view taken along line II—II in FIG. 1.
Figure 3:
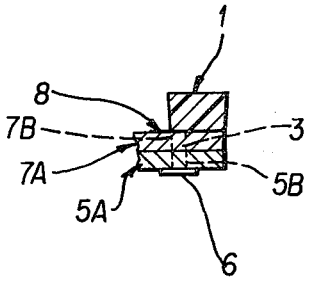
FIG. 3 is partial elevational view of the edge trim on the periphery of the floor panel showing an adhesive bond and a rivet after being headed.
Figure 4:
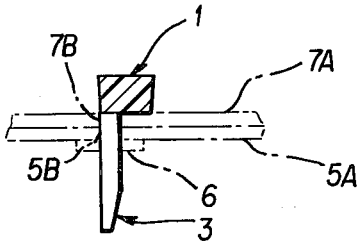
FIG. 4 is a partial elevational view of the edge trim on the periphery of the floor panel showing a rivet both before and after being headed.

Referring now to FIGS. 1–4, each of edge trim structure or member 1 incorporates a continuous corner 2 which locates the joints between edge trim sections at the center of each side of a horizontally oriented panel 7 which itself is made of, for example, steel such that the continuous corner and the edge trim structure itself is located at a place far less vulnerable to in service damage and on which is mounted a horizontally oriented floor covering 17 having a peripheral edge 18. Four identical angle shaped and separate, horizontally planar edge trim members or structures 1 surround and enclose the peripheral edge 18 of floor covering 17 and the finished appearance of all corners 2 is consistent and uniform throughout the floor system with the top surface portion 19 of the floor covering 17 being flush with the top surface portion 20 of the edge trim structure 1.

Each of the edge trim members or structures 1 can be affixed to the steel panel by means of an adhesive bond matrix along the peripheral portion 7A of the panel 7. For additional strength, the option of an integral rivet 3 at the continuous corner 2 of the edge trim may be used. Four corner holes are punched at the corners of steel panel 7, allowing for positive positioning of each edge trim structure or member 1 and a mechanical fixing of the continuous corner 2.

Panel 7 includes a side wall 5 having an upper peripheral flange portion 5A extending therefrom. At least one aperture 5B is formed in flange portion 5A. Peripheral portion 7A of panel 7 also includes a number of apertures 7B formed therein which are aligned with apertures 5B upon the punching of a hole through peripheral portion 7A and flange portion 5A during manufacturing.

Rivet 3 passes down through each aligned aperture 5B and 7B and is headed in the manufacturing operation to mechanically capture the edge trim 1 in place by a headed portion 6. Since the steel panel 7 has not been deformed to capture the edge trim 1, should severe abuse make it necessary to replace the trim, such can accordingly be readily accomplished without the use of any special tools.

For maximum mechanical attachment, a series of aligned apertures 5B and 7B are formed by punching holes in the peripheral flange 7A of the steel panel and in the flange portion 5A, and a series of intergal rivets are used as part of the edge trim structure 1 to mechanically attach the edge trim 1 to the steel panel 7 in addition to the adhesive bond 8. This method of assembly makes it possible, as previously noted, to locate and position the separate edge trim structures 1 most accurately, independently of other manufacturing tolerances. Since the edge trim structure 1 determines the overall panel size, this critical dimension is more tightly controlled and the series of integral rivets 3 are headed so as to form headed portion 6 in production in the same manner as a single corner rivet 3 is headed. Accordingly, should severe abuse to the panel 7 and edge trim structure 1 occur so as to make it necessary to replace one or more of the separate edge trim structures 1, such can be done without the use of any special tools.

Each of the separate edge trim structures 1 which, in turn, each include first and second leg portions 1A, 1B, respectively, may be constructed of plastic, vinyl or similar suitable material.

Obviously, numerous modifications and variations of the present invention are possible in light of the above teachings. It is therefore to be understood that within the scope of the appended claims, the invention may be practiced otherwise than as specifically described herein.

What is claimed and desired to be secured by Letters Patent of the United States is:

1. An edge trim structure for a horizontally oriented access floor panel having a horizontally oriented floor covering with a peripheral edge, mounted thereon, comprising:

at least a first and second separate horizontally planar edge tirm member mounted on said panel and abutting said peripheral edge of said floor covering wherein each of said first and second separate edge trim members includes a first and second edge trim leg member; and at least one continuous, one-piece edge trim corner member interconnecting said first and second edge trim leg member of each of said first and second separate edge trim members wherein said panel further comprises a horizontally planar peripheral portion upon which said first and second horizontally planar edge trim members are mounted and a side wall portion having a flange horizontally extending therefrom connected to said peripheral portion of said panel.

2. An edge trim structure as set forth in claim 1, further comprising:

means for attaching each of said first and second separate edge trim members to said panel.

3. An edge trim structure as set forth in claim 2, wherein said attaching means further comprises adhesive means for adhering each of said first and second separate edge trim members to said panel.

4. An edge trim structure as set forth in claim 2, wherein said attaching means further comprises at least one securing member integrally projecting from each of said first and second separate edge trim members and operatively engaging said panel.

5. An edge trim structure as set forth in claim 2, wherein said attaching means further comprises:

adhesive means for adhering each of said first and second separate edge trim members to said panel; and at least one securing member integrally projecting from each of said first and second separate edge trim members and operably engaging said panel.

6. An edge trim structure as set forth in claims 4 or 5, wherein said at least one securing member comprises a rivet extending from said corner member.

7. An edge trim structure as set forth in claims 4 or 5, wherein said at least one securing member comprises a rivet extending from said corner member and at least one rivet extending from each of said first and second leg members of each of said first and second separate edge trim members.

8. An edge trim structure as set forth in claim 1, wherein each of said first and second separate edge trim members further comprises vinyl.

9. An edge trim structure as set forth in claim 1, wherein each of said first and second separate edge trim members further comprises plastic.

10. An edge trim structure as set forth in claim 1, wherein each of said first and second separate edge trim members comprises an electrically non-conductive material.

11. An edge trim structure as set forth in claims 1 or 4, wherein said peripheral portion has at least one aperture formed therein and said flange portion extending from said side wall portion includes at least one aperture formed therein in alignment with said at least one aperture formed in said peripheral portion and within which said at least one securing member is disposed.

12. An edge trim structure as set forth in claim 11, wherein said securing means further comprises a rivet having a headed portion which operably engages said flange portion so as to secure each of said first and second separate edge trim members to said peripheral portion.

13. An edge trim structure as set forth in claim 1, wherein said at least first and second separate edge trim members further comprises four separate edge trim members and wherein said at least one corner member further comprises four corner members interconnecting, respectively, said first and second edge trim leg members of each of said first and second separate edge trim members.

14. An edge trim structure as set forth in claim 1, wherein a top surface portion of said floor covering is flush with a top surface portion of said edge trim members.

* * * * *